US009603427B2

(12) United States Patent
Caponey

(10) Patent No.: US 9,603,427 B2
(45) Date of Patent: Mar. 28, 2017

(54) RETRACTABLE FLAP FOR RING BINDER ATTACHMENT

(71) Applicant: Michael Caponey, Cumming, GA (US)

(72) Inventor: Michael Caponey, Cumming, GA (US)

( * ) Notice: Subject to any disclaimer, the term of this patent is extended or adjusted under 35 U.S.C. 154(b) by 108 days.

(21) Appl. No.: 14/160,458

(22) Filed: Jan. 21, 2014

(65) Prior Publication Data

US 2015/0203249 A1 Jul. 23, 2015

(51) Int. Cl.

| | |
|---|---|
| ***B65D 30/00*** | (2006.01) |
| ***A45C 13/00*** | (2006.01) |
| ***A45C 3/00*** | (2006.01) |

(52) U.S. Cl.

CPC ..... *A45C 13/001* (2013.01); *A45C 3/00* (2013.01)

(58) Field of Classification Search

USPC ..... 373/17, 16; 383/17, 16, 13, 14, 21, 121

See application file for complete search history.

(56) References Cited

U.S. PATENT DOCUMENTS

| | | | | |
|---|---|---|---|---|
| 3,351,064 | A * | 11/1967 | Cohn | B42F 5/00 220/694 |
| 4,461,402 | A * | 7/1984 | Fell | B65D 90/046 105/423 |
| 4,781,472 | A * | 11/1988 | LaFleur | B65D 88/1618 383/105 |
| 5,323,922 | A * | 6/1994 | Lapoint, Jr. | B65D 88/1625 220/4.28 |
| 5,738,460 | A * | 4/1998 | Flynn | B42F 13/0006 281/29 |
| 6,739,753 | B2 * | 5/2004 | Richardson, Jr. | B65D 88/1618 220/495.03 |
| 7,080,756 | B2 * | 7/2006 | Cunningham | A47F 9/042 206/554 |
| 7,628,426 | B1 * | 12/2009 | Rowe | B42F 11/00 281/29 |
| 2003/0052786 | A1 * | 3/2003 | Dickinson | B65D 5/4233 340/572.8 |

* cited by examiner

*Primary Examiner* — Christopher Demeree

(57) ABSTRACT

An apparatus is disclosed that facilitates the attachment of a bag to one or more rings. The apparatus can be disguised as a surface of the bag, and can pivot into a securing position. In embodiments, the apparatus can comprise one or more openings for accepting one or more rings, and one or more hook-and-loop fasteners for facilitating the temporary attachment of the apparatus to a bag.

12 Claims, 3 Drawing Sheets

RETRACTABLE FLAP FOR RING BINDER ATTACHMENT

TECHNICAL FIELD

This disclosure relates generally to the field of totes and other items for storage.

BACKGROUND

Bags, totes, and other items used for carrying or storing various objects have both functional and aesthetic purposes. Typically, an individual uses a variety of different bags or totes throughout a given week, or even a single day. For example, a traveler will generally have a need for a variety of bags during a trip (e.g., handbags, beach-bags, tote bag, toiletry bag, etc.). As another example, an individual might use a different handbag or purse from day to day. Therefore, it is desirable to improve upon apparatuses for carrying one or more bags, totes, and/or other items used for carrying or storing various objects.

Therefore, there remains a need for an apparatus that is operable to facilitate the efficient transport of one or more bags, totes, and/or other items used or carrying or storing various objects.

BRIEF DESCRIPTION OF THE DRAWINGS

Like reference numbers and designations in the various drawings indicate like elements.

DETAILED DESCRIPTION

Figure 1:
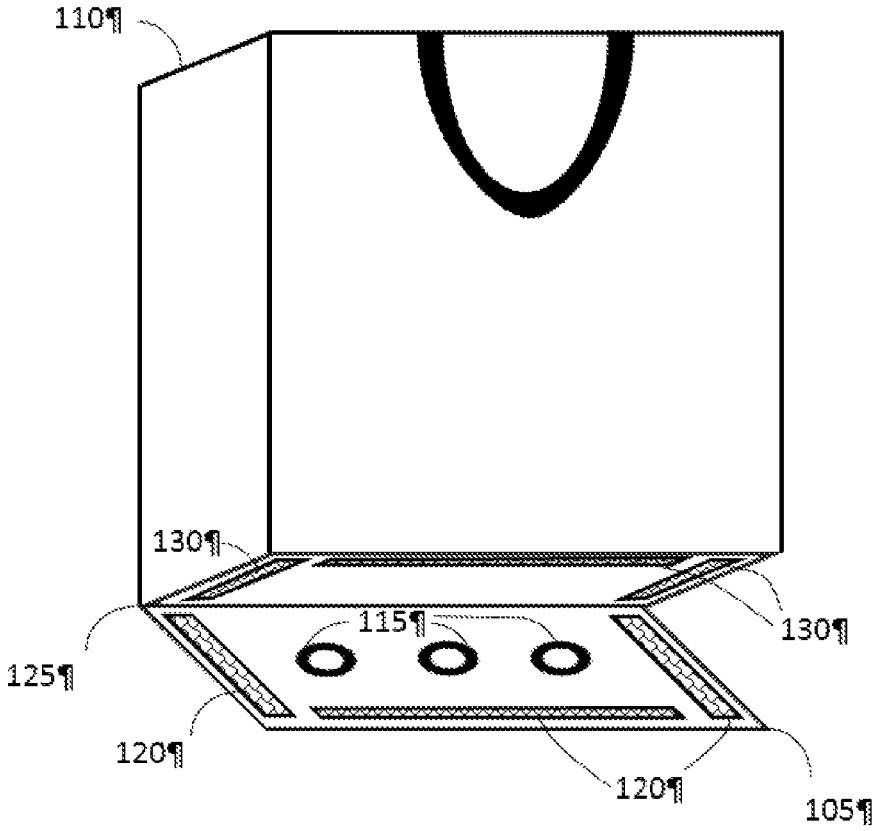
FIG. 1 shows a front perspective view of a securing flap attached to a bag.

In embodiments, a securing flap can be operable to facilitate the attachment of an object to one or more rings. In embodiments, the securing flap can be attached to a bag, and the securing flap can allow the bag to be attached to one or more rings. Throughout this disclosure, the term "bag" shall refer to a tote, handbag, purse, toiletry bag, pouch, or any other object used for carrying or storing one or more items.

In embodiments, the securing flap can be operable to pivot toward and away from a surface of a bag, the securing flap being attached to said surface of the bag. In embodiments, the securing flap and/or the bag can comprise a means for temporarily holding the securing flap against the surface of the bag. The means for temporarily holding the securing flap against the surface of the bag can allow the securing flap to be disguised against the surface of the bag.

Other attributes of the present invention will become readily apparent to those skilled in the art from the following description, wherein there is shown and described the various embodiments of the invention. As will be realized from the following description, the present invention is capable of various other embodiments and its several details are capable of modifications in various aspects without departing from the scope of the invention. Accordingly, the drawing and descriptions will be regarded as illustrative in nature and not as restrictive.

Referring now to the drawings, the following detailed description provides principles and concepts to enable a person skilled in the art to make and use a new securing flap for attachment of a bag to one or more rings. The figures and various drawings, which are not necessarily drawn to scale, are not intended to limit the scope of the present invention. The scope of the present invention includes not only that which is described in this disclosure, but also that which is known in the prior art and alternative embodiments of the present invention which may be contemplated by those skilled in the relevant art and which are taught by this disclosure.

Throughout the following detailed description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

FIG. 1 shows a front perspective view of a securing flap 105 attached to a bag 110. The securing flap 105 can comprise one or more openings operable to facilitate securing the securing flap to one or more rings, one or more means for temporarily attaching a flat side of the securing flap 105 to the bag 110, and a means for attaching an edge of the securing flap 105 to the bag 110. While the securing flap 105 is depicted in FIG. 1 as being attached to the bottom surface of the bag 110, it should be understood that the securing flap 105 can be attached to any surface of a bag 110.

In embodiments, the securing flap 105 can be a piece of material having an inside flat surface and an outside flat surface. While the securing flap 105 is shown in FIG. 1 as a thin, rectangular piece of material, it should be understood that the securing flap 105 can be of a variety of shapes, widths, lengths, and thicknesses. It should be understood that the securing flap 105 can be made from a variety of materials (e.g., leather, faux leather, vinyl, plastic, cloth, or any other flexible or rigid fabric or other material). For example, the securing flap 105 can be made from the same, or a similar, material as the bag 110.

In embodiments, the one or more openings operable to facilitate securing the securing flap 105 to one or more rings can be one or more grommets 115. Each of the grommets 115 can be of such a diameter as to encompass a ring (e.g., ring from a ring binder). In embodiments, each of the grommets 115 can create an opening in the securing flap 105. It should be understood that the securing flap can include any number of grommets 115 and the grommets 115 can be placed in a variety of patterns.

In embodiments, the one or more means for temporarily attaching a flat side of the securing flap 105 to the bag 110 can be one or more hook and loop fastener strips 120. In embodiments, one or more hook and loop fastener strips 120 can be positioned along one or more of the edges of the inside flat surface of the securing flap 105. It should be understood that the one or more means for temporarily attaching a flat side of the securing flap 105 to the bag 110 can be one or more magnets or any other means for temporarily attaching one object to another. For example, one or more straps or a malleable bottom pocket to tuck the securing flap 105 or an edge of the securing flap into can also be used for temporarily attaching a flat side of the securing flap 105 to the bag 110.

In embodiments, one or more hook and loop fastener strips 125 can be positioned on the surface of the bag 110 to which the securing flap 105 is attached. The hook and loop fastener strips 125 can comprise an opposing surface relative to the surface of the hook and loop fastener strips 120 attached to the securing flap 105. For example, where the securing flap's hook and loop fastener strips are hook-surfaced, the bag's hook and loop fastener strips can be loop-surfaced, and vice versa. In embodiments, the one or more hook and loop fastener strips 125 can be positioned on the bag 110 in a pattern that mirrors the pattern of the securing flap's hook and loop fastener strips 120.

In embodiments, the means for attaching an edge of the securing flap 105 to the bag 110 can comprise stitching an edge 130 of the securing flap 105 to a corresponding edge 130 of the bag 110. The edge 130 of the securing flap 105 can be attached to the corresponding edge 130 of the bag 110 in such a way as to allow the securing flap 105 to pivot toward and away from the surface of the bag 110. It should be understood that the means for attaching an edge of the securing flap 105 to the bag 110 can comprise various other attachment means (e.g., adhesive, glue, staples, tacking, etc.).

Figure 2:
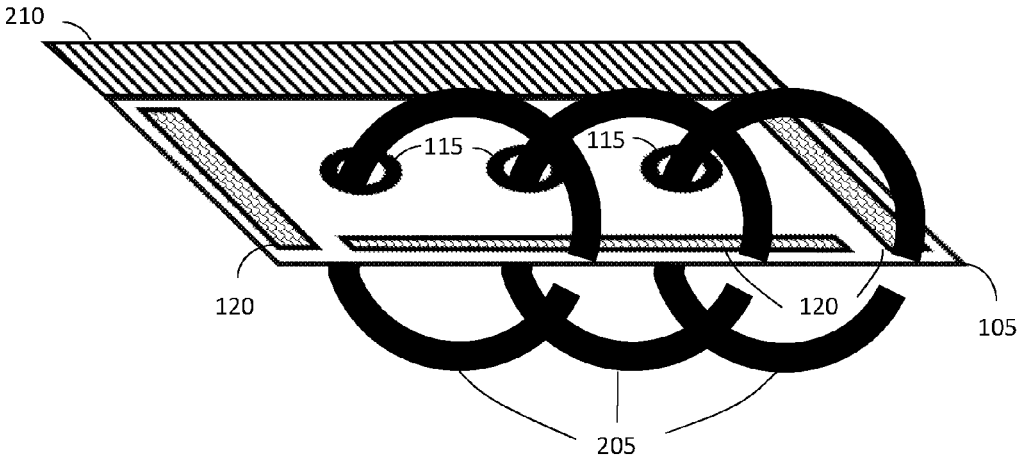
FIG. 2 shows a front perspective view of a securing flap attached to rings.

FIG. 2 shows a front perspective view of a securing flap 105 attached to ring(s) 205. In embodiments, ring(s) 205 can be passed through the grommets 115 to attach the securing flap 105 to the ring(s) 205.

In embodiments, the securing flap 105 can comprise a hinge region 210. The hinge region 210 can include a means for pivoting the securing flap 105 toward or away from a surface of a bag (e.g., bag 110 of FIG. 1). For example, the means for pivoting the securing flap 105 toward or away from a surface of a bag can be stitching each of the edges of the hinge region 210 to the bag, thus making the hinge region 210 a pivot point for the securing flap 105. It should be understood that the means for pivoting the securing flap 105 toward or away from a surface of a bag can include other means for attaching each of the edges of the hinge region 210 to the bag (e.g., adhesive, glue, staples, tacking, etc.).

Figure 3:
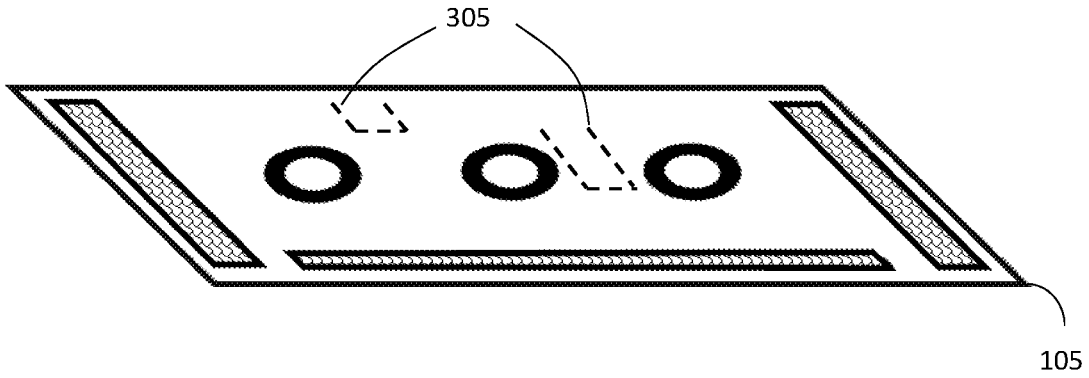
FIG. 3 shows a front perspective view of a securing flap having multiple security pouches.

FIG. 3 shows a front perspective view of a securing flap 105 having multiple security pouches 305. In embodiments, one or more security pouches 305 can be attached to the inner surface of a securing flap 105. For example, one or more security pouches 305 can be attached to a securing flap 105 by stitching the security pouches 305 to the securing flap 105. In embodiments, a security pouch 305 can be semi-enclosed, having an opening that can vary in size and shape. For example, a security pouch 305 can be a rectangular piece of fabric that is stitched to a securing flap 105 along three of the security pouch's edges. It should be understood that the security pouches 305 can be of various shapes and sizes. It should be further understood that the one or more security pouches 305 can be attached to the securing flap 105 using various other means for attachment (e.g., adhesive, glue, staples, tacking, etc.).

In embodiments, the security pouches 305 can be used to hold various items or objects. For example, a security pouch 305 can be so dimensioned as to hold personal items (e.g., license, keys, business cards, credit cards, jewelry, cash, etc.). In embodiments, a security pouch 305 can be so dimensioned as to hold a security device (e.g., anti-shop-lifting device, tracking device, sensor, etc.), It is, of course, not possible to describe every conceivable combination of components or methodologies for purposes of describing the claimed subject matter, but one of ordinary skill in the art can recognize that further combinations and permutations of such matter are possible. Accordingly, the claimed subject matter is intended to embrace all such alterations, modifications and variations that fall within the spirit and scope of the appended claims.

What is claimed is:

1. A flat, rectangular flap for attaching an item to one or more rings, the flap comprising:

a fixed edge that is permanently affixed to an outer surface of a bag, thereby allowing an edge opposite to the fixed edge to pivot toward and away from the bottom, exterior surface of the bag, wherein the bag comprises a plurality of walls and the bottom surface encompassing an interior of the bag;

means for temporarily securing a first surface of the flat, rectangular flap against the outer surface of the bag, wherein the means for temporarily securing the flap against the outer surface of the bag comprises one or more hook and loop fastener strips on the first surface of the flap, wherein the one or more hook and loop fastener strips are located on the first surface of the flap so as to mate with corresponding hook and loop fastener strips that are located on the outer surface of the bag;

wherein a width and a length of the flap are substantially equivalent to corresponding width and length dimensions of the bottom surface of the bag to which the flap is attached;

three openings through the flap, wherein the three openings form a straight line along the flap, and wherein each respective one opening comprises a grommet, each respective one grommet being dimensioned so as to allow a binder ring to pass through the respective one grommet; and a semi-enclosed pouch that is dimensioned so as to retain a tracking device.

2. The flap of claim 1, wherein means for securing the flat surface of the flap to the surface of the item comprises one or more straps.

3. The flap of claim 1, wherein means for securing the flat surface of the flap to the surface of the item comprises one or more magnets.

4. The flap of claim 1, wherein the means for attaching the single edge of the flap to the item comprises stitching the single edge of the flap to the item.

5. The flap of claim 1, further comprising, one or more semi-enclosed pouches.

6. A bag comprising the flap of claim 1.

7. The flap of claim 1, wherein the one or more rings are included within a ring binder.

8. A carrying device comprising:

a first set of one or more hook and loop fastener strips, the first set of one or more hook and loop fastener strips being attached to a surface of the carrying device; and a flat, rectangular flap, wherein a fixed edge of the flap is permanently affixed to an outer surface of the carrying device, thereby allowing the edge of the flap opposite to the fixed edge to pivot toward and away from the bottom, exterior surface of the carrying device, wherein a width and a length of the flap are substantially equivalent to corresponding width and length dimensions of a bottom surface of the carrying device, the flap comprising:

means for temporarily securing a first surface of the flat, rectangular flap against the outer surface of the bag, wherein the means for temporarily securing the flap against the outer surface of the bag comprises a second set of one or more hook and loop fastener strips located on the first surface of the flap, the second set of one or more hook and loop fastener strips having surfaces opposing the surfaces of the first set of one or more hook and loop fastener strips; and three grommets positioned in a straight line with respect to each other along the flap, wherein each respective one grommet is dimensioned so as to allow a binder ring to pass through the respective one grommet; and a semi-enclosed pouch that is dimensioned so as to retain a tracking device.

9. The carrying device of claim 8, wherein the flap is attached to the carrying device by stitching a single edge of the flap to the carrying device.

10. The carrying device of claim 8, wherein the flap further comprises one or more semi-enclosed pouches.

11. The carrying device of claim 8, wherein the second set of one or more hook and loop fastener strips are attached to the flap in a pattern that mirrors the pattern of the first set of one or more hook and loop fastener strips.

12. The carrying device of claim 8, wherein the one or more rings are included within a ring binder.

* * * * *